US011396680B2

(12) United States Patent
Zhang et al.

(10) Patent No.: US 11,396,680 B2
(45) Date of Patent: Jul. 26, 2022

(54) STEEL FOR COILED TUBING WITH LOW YIELD RATIO AND ULTRA-HIGH STRENGTH AND PREPARATION METHOD THEREOF

(71) Applicant: BAOSHAN IRON & STEEL CO., LTD., Shanghai (CN)

(72) Inventors: Chuanguo Zhang, Shanghai (CN); Leilei Sun, Shanghai (CN); Lei Zheng, Shanghai (CN); Houjun Pang, Shanghai (CN); Jian Liu, Shanghai (CN); Yong Zhang, Shanghai (CN); Guodong Xu, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 117 days.

(21) Appl. No.: 16/758,528

(22) PCT Filed: Oct. 25, 2018

(86) PCT No.: PCT/CN2018/111845

§ 371 (c)(1),
(2) Date: Apr. 23, 2020

(87) PCT Pub. No.: WO2019/080893

PCT Pub. Date: May 2, 2019

(65) Prior Publication Data

US 2020/0255917 A1 Aug. 13, 2020

(30) Foreign Application Priority Data

Oct. 27, 2017 (CN) ..... 201711022596.5

(51) Int. Cl.

| | |
|---|---|
| ***C21D 9/08*** | (2006.01) |
| ***C21D 6/00*** | (2006.01) |
| ***C21D 8/10*** | (2006.01) |
| ***C22C 38/00*** | (2006.01) |
| ***C22C 38/02*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/58*** | (2006.01) |

(52) U.S. Cl.

CPC ..... *C21D 9/08* (2013.01); *C21D 6/004* (2013.01); *C21D 6/005* (2013.01); *C21D 6/008* (2013.01); *C21D 8/105* (2013.01); *C22C 38/001* (2013.01); *C22C 38/004* (2013.01); *C22C 38/02* (2013.01); *C22C 38/42* (2013.01); *C22C 38/44* (2013.01); *C22C 38/46* (2013.01); *C22C 38/48* (2013.01); *C22C 38/50* (2013.01); *C22C 38/58* (2013.01); *C21D 2211/002* (2013.01); *C21D 2211/005* (2013.01)

(58) Field of Classification Search

CPC ..... C21D 2211/002; C21D 2211/005; C21D 6/004; C21D 6/005; C21D 6/008; C21D 8/10; C21D 8/105; C21D 9/08; C22C 33/04; C22C 38/001; C22C 38/004; C22C 38/02; C22C 38/04; C22C 38/06; C22C 38/42; C22C 38/44; C22C 38/46; C22C 38/48; C22C 38/50; C22C 38/58

See application file for complete search history.

(56) References Cited

U.S. PATENT DOCUMENTS

2010/0119860 A1* 5/2010 Hitoshi ..... C21D 9/08 428/586

FOREIGN PATENT DOCUMENTS

| | | | |
|---|---|---|---|
| CN | 101487101 | | 7/2009 |
| CN | 101634001 | | 1/2010 |
| CN | 101871081 | A | 10/2010 |
| CN | 102828120 | A | 12/2012 |
| CN | 104451427 | | 3/2015 |
| CN | 105886915 | | 8/2016 |
| EP | 2799575 | A1 | 5/2014 |
| JP | 2000158192 | A | 6/2000 |

(Continued)

OTHER PUBLICATIONS

First Search Report dated Oct. 27, 2017 in co-pending Chinese Patent Application No. CN10972261 filed Oct. 27, 2027.

(Continued)

*Primary Examiner* — Jenny R Wu

(74) *Attorney, Agent, or Firm* — Lei Fang; Smith Tempel Blaha LLC

(57) ABSTRACT

Steel for coiled tubing with a low yield ratio and ultra-high strength and a preparation method thereof, wherein the chemical composition of the steel in mass percentage is: C: 0.05-0.16%, Si: 0.1-0.9%, Mn: 1.25-2.5%, P≤0.015%, S≤0.005%, Cr: 0.51-1.30%, Nb: 0.005-0.019%, V: 0.010-0.079%, Ti: 0.01-0.03%, Mo: 0.10-0.55%, Cu: 0.31-0.60%, Ni: 0.31-0.60%, Ca: 0.0010-0.0040%, Al: 0.01-0.05%, N≤0.008%, and the rest being Fe and inevitable impurity elements. The chemical composition combines the technologies of low temperature finishing rolling and low temperature coiling to obtain an MA constituent+bainite+ferrite multiphase structure. The steel has a low yield ratio and ultra-high strength with the following specific properties: yield strength≥620 MPa, tensile strength≥750 MPa, elongation≥11%, and yield ratio≤0.83, and is suitable for manufacturing coiled tubing with ultra-high strength having a grade of 110 ksi or higher.

4 Claims, 1 Drawing Sheet

(56) References Cited

FOREIGN PATENT DOCUMENTS

| | | | | |
|---|---|---|---|---|
| JP | 2001303206 | | | 10/2001 |
| JP | 2012017522 | A | * | 1/2012 |
| RU | 2437954 | C1 | | 12/2011 |
| RU | 2437955 | C1 | | 12/2011 |
| WO | 2017130875 | A1 | | 8/2017 |

OTHER PUBLICATIONS

First Office Action dated Oct. 21, 2019 in co-pending Chinese Patent Application No. CN10972261 filed Oct. 27, 2027.
Decision to Grant dated Jun. 16, 2020 in co-pending Chinese Patent Application No. CN10972261 filed Oct. 27, 2027.
Office Action dated Apr. 20, 2021 in co-pending Japanese Patent Application No. 2020521899 filed Oct. 25, 2018.
First Search Report dated Jan. 10, 2020 in co-pending Russian Patent Application No. 2020116360 filed Oct. 25, 2018.
Office Action dated Oct. 21, 2020 in co-pending Russian Patent Application No. 2020116360 filed Oct. 25, 2018.
Decision to Grant dated Dec. 25, 2020 in co-pending Russian Patent Application No. 2020116360 filed Oct. 25, 2018.
Decision to Grant dated Jun. 3, 2021 in co-pending Canadian Patent Application No. 3,078,406 dated Oct. 25, 2018.
International Search Report and Written Opinion dated Jan. 8, 2019 for PCT Patent Application No. PCT/CN2018/111845.

* cited by examiner

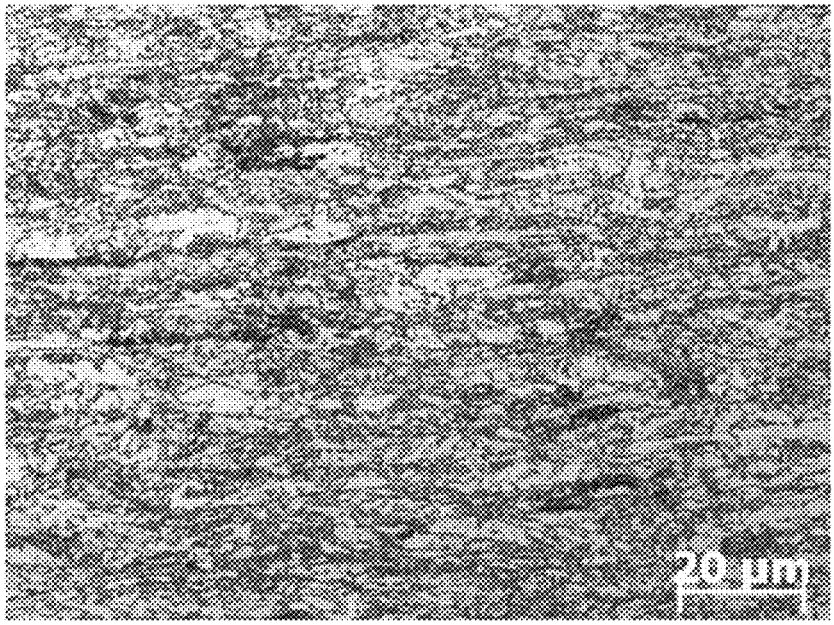
20 μm

STEEL FOR COILED TUBING WITH LOW YIELD RATIO AND ULTRA-HIGH STRENGTH AND PREPARATION METHOD THEREOF

CROSS-REFERENCE TO RELATED APPLICATIONS

This application is a 371 U.S. National Phase of PCT International Application No. PCT/CN2018/111845 filed on Oct. 25, 2018, which claims benefit and priority to Chinese patent application no. 201711022596.5 filed on Oct. 27, 2017, which is incorporated by reference herein in its entirety.

TECHNICAL FIELD

The present invention relates to a steel for coiled tubing with low yield ratio and ultra-high strength and a manufacturing method thereof.

BACKGROUND ART

Compared with the conventional threaded connecting tubing, coiled tubing (CT) (also known as continuous tube, flexible tubing, serpentine tube or coil tube) which can be wound on a drum with a large diameter is a jointless coiled tubing formed through a miter joint of several sections of steel strips and then rolling and welding. The coiled tubing is mainly used for auxiliary operations such as well logging and completion in oilfield. With the continuous progress of the coiled tubing equipment technology in the past ten years, its application in the field of drilling has developed rapidly.

The coiled tubing requires specialized equipment for operation, and has many advantages such as strong mobility, flexible operation, and reusability. However, the coiled tubing is subject to repeated deformations such as bending, clamping, and stretching during use, which results in complicated stress conditions and poor working conditions. Therefore, local damage to the coiled tubing is often an important inducement for its overall failure. Studies have shown that high strength is conducive to improving the load resistance, torsional resistance and fatigue strength of coiled tubing, and low yield ratio is conducive to improving the uniform elongation performance and work hardening capacity of coiled tubing. Therefore, with the increasing depth of oil drilling and the exploitation of unconventional oil and gas fields, higher requirements have been placed on operating depth, operating pressure and torsional resistance, which requires high-end coiled tubing with ultra-high strength, high fatigue and certain corrosion resistance to ensure higher load capacity and longer service life.

The coiled tubing has been developed and applied for more than 50 years, and its material has also undergone multiple development stages. In the 1960s and 1970s, the coiled tubing was mainly made of carbon steel, and the carbon steel coiled tubing had low strength, many weld joints, and poor corrosion resistance, which could not resist cyclic bending and tensile force. Therefore, the coiled tubing caused frequent accidents during use, which had severely restricted the development of coiled tubing technology. In the 1980s and 1990s, with the continuous development of metallurgical technology and welding technology, low-alloy high-strength steel and oblique butt welding technology were applied in the field of coiled tubing manufacturing, and the service life and reliability of coiled tubing were therefore greatly improved. Subsequently, the coiled tubing products with high strength and long life made from titanium alloy material, composite material and the like were developed, but they were not popularized and widely applied due to excessive manufacturing and maintenance costs. Therefore, at the present stage, the manufacturing of coiled tubing is still dominated by low-alloy and high-strength steel.

Chinese patent 200710168545.3 discloses a steel for high-plasticity coiled tubing and a manufacturing method thereof, which are mainly aimed at the development of steel with CT70 or higher steel grade and for coiled tubing. In this patent, the steel for coiled tubing with moderate toughness and uniform structure is produced by adopting an alloy design with low Mn, low Cr and V-free, and steelmaking process control and controlled rolling air-cooling process control. Such steel has a small resistance to deformation during rolling, thereby causing little loss to the rolling mill. However, due to the low strength of the steel strips, such steel cannot meet the manufacturing requirements of the coiled tubing with a grade of 110 ksi, and the low cycle fatigue life is also low.

Chinese patent CN104046918A discloses a steel strip for manufacturing coiled tubing with a yield strength of 80 ksi or higher. The main compositions are 0.17-0.35% of C, 0.30-2.00% of Mn, 0.10-0.30% of Si and 0.010-0.040% of Al, and the upper limits of S and P are controlled to be 100 ppm and 150 ppm, respectively. Microstructures of tempered martensite and bainite are obtained through reasonable process control. The coiled tubing made of such steel strip contains more than 90% by volume of tempered martensite. Due to the presence of a relatively large proportion of martensite structure, it is not conducive to the acid resistance of the finished steel pipe.

SUMMARY OF THE INVENTION

The object of the present invention is to provide a steel for coiled tubing with low yield ratio and ultra-high strength and a manufacturing method thereof. The steel has a yield strength of 620 MPa or more, a tensile strength of 750 MPa or more, an elongation of 11% or more and a yield ratio of 0.83 or less, and is used for manufacturing coiled tubing with ultra-high strength of 110 ksi or higher.

To achieve the above object, the technical solutions of the present invention are as follows.

In the present invention, based on the material theory such as grain refinement, precipitation strengthening, and phase transition control, a steel for coiled tubing with ultra-high strength and having a MA constituents (Martensite-Austenite constituents)+bainite+ferrite multiphase microstructure is obtained by adopting a composition design of low to medium C content, V/Nb microalloying and Cu/Ni/Cr/Mo alloying in combination with the technique of controlling the rolling and cooling, and the technique of low-temperature coiling. The steel has characteristics of low yield ratio, high strength and good adaptability to heat treatment.

A steel for coiled tubing with low yield ratio and ultra-high strength, comprising the following chemical composition in percentage by mass: C: 0.05-0.16%, Si: 0.1-0.9%, Mn: 1.25-2.5%, P≤0.015%, S≤0.005%, Cr: 0.51-1.30%, Nb: 0.005-0.019%, V: 0.010-0.079%, Ti: 0.01-0.03%, Mo: 0.10-0.55%, Cu: 0.31-0.60%, Ni: 0.31-0.60%, Ca: 0.0010-0.0040%, Al: 0.01-0.05%, N≤0.008%, and the rest being Fe and inevitable impurity elements.

Further, the steel for coiled tubing with low yield ratio and ultra-high strength has a microstructure consisting of MA constituents+bainite+ferrite multiphase structure.

The steel for coiled tubing with low yield ratio and ultra-high strength has a yield strength ($R_{p0.2}$) of 620 MPa or more, a tensile strength ($R_m$) of 750 MPa or more, an elongation ($A_{50}$) of 11% or more and a yield ratio ($R_{p0.2}/R_m$) of 0.83 or less.

The present invention adopts a low-carbon and microalloying composition design, and the design basis is as follows:

Carbon (C): C is the most basic strengthening element. C dissolves in steel to form an interstitial solid solution, in which the C plays the role of solution strengthening. C forms carbide precipitates with elements that easily form carbides, in which the C plays the role of precipitation strengthening. However, too high content of C is not conducive to the ductility, toughness and welding performance of steel, and too low content of C reduces the strength of steel. Therefore, the C content of the present invention is controlled to 0.05-0.16%.

Silicon (Si): Si is an element for solid solution strengthening, and can effectively improve the tensile strength of steel. Si is also a deoxidizing element in steel. However, too high content of Si will deteriorate the welding performance of steel, and is not conducive to the removal of hot-rolled iron oxide scale during the rolling. Therefore, the Si content of the present invention is controlled to 0.1-0.9%.

Manganese (Mn): Mn improves the strength of steel by solid solution strengthening. Mn is the main and most economical strengthening element in steel to compensate for the loss of strength caused by the decrease of C content. Mn is also an element that expands the γ phase region. It can reduce phase transition temperature of γ→α in steel, help to obtain fine phase transition microstructure, and improve the toughness of steel. Therefore, the Mn content of the present invention is controlled to 1.25-2.5%.

Chromium (Cr): Cr is an important element to improve the hardenability of steel and effectively improves the strength of steel. Cr is also an element for forming ferrite and promotes the precipitation of ferrite. When the Cr content is 0.51% or more, a dense passivation film with spinel structure can be formed on the surface of the steel, which significantly improves the corrosion resistance of the steel. However, the addition of too high contents of chromium and manganese to the steel at the same time will cause the formation of low-melting Cr—Mn composite oxides and the formation of surface cracks during hot working, and will deteriorate the welding performance seriously. Therefore, the Cr content of the present invention should be controlled to 0.51-1.30%.

Titanium (Ti): Ti is an element that easily forms carbonitride. The undissolved carbonitride of Ti can prevent the growth of austenite grains when the steel is heated, and the precipitated TiN and TiC during rough rolling in the high temperature austenite zone can effectively suppress the growth of austenite grains. In addition, during the welding process, TiN and TiC particles in the steel can significantly prevent the grain growth in the heat-affected zone, thereby improving the welding performance of the steel sheet and having a significant effect on improving the impact toughness of the welding heat-affected zone. Therefore, the Ti content of the present invention is controlled to 0.01-0.03%.

Niobium (Nb): Nb is a microalloying element. During hot rolling, the solid solution Nb is subjected to strain-induced precipitation to form Nb (N, C) particles which pin the grain boundary to suppress the growth of deformed austenite, thereby allowing the deformed austenite phase to be transformed into fine grain with a high dislocation density by controlling the rolling and cooling; the solid solution Nb disperses and precipitates in the matrix as a second phase particles NbC, and plays the role of precipitation strengthening. However, if the content of Nb is too low, the effects of dispersion and precipitation will be not obvious, and Nb cannot play the role of refining the grains and strengthening the matrix; if the content of Nb is too high, it will be easy to generate slab cracks, the surface quality will be affected and the welding performance will seriously deteriorate. Therefore, the Nb content of the present invention should be controlled to 0.005-0.019%.

Vanadium (V): V is a microalloying element. The precipitation phase VN of solid solution V during hot rolling can effectively pin the grain boundary to suppress the growth of deformed austenite, thereby allowing the deformed austenite phase to be transformed into fine products with a high dislocation density by controlling the rolling and cooling; the solid solution V disperses and precipitates in the matrix as VC particles during the coiling and temperature holding process, and plays the role of precipitation strengthening. The present invention mainly utilizes the grain refining and precipitation strengthening effects of V to control the structure properties of steel. However, if the content of V is too low, the effects of dispersion and precipitation will be not obvious, and V cannot play the role of refining the grains and strengthening the matrix; if the content of V is too high, it will be easy for precipitation phase particles to grow, and V also cannot play the role of strengthening precipitation. Therefore, the V content of the present invention should be controlled to 0.010-0.079%.

Molybdenum (Mo): Mo is an element that expands γ phase region and has the following advantages: Mo can reduce phase transition temperature of γ→α in steel, effectively promote the bainite transformation and play the role of strengthening the matrix, obtain a finer microstructure, and promote the formation of MA constituents; Mo can also play the role of overcoming tempering brittleness during heat treatment, and improve the heat treatment performance and fatigue performance. In high-strength and low-alloyed steels, the yield strength increases with the increase of Mo content, so too high content of Mo is detrimental to plasticity. Therefore, the Mo content of the present invention is controlled to 0.10-0.55%.

Copper and nickel (Cu, Ni): Cu and Ni can improve the strength of steel by solid solution strengthening. Cu can also improve the corrosion resistance of steel. The addition of Ni is mainly for improving the hot brittleness caused by Cu in steel and is beneficial to the toughness. Both contents of Cu and Ni are controlled to 0.31-0.60%.

Sulfur and phosphorus (S, P): S and P are inevitable impurity elements in steel, so their contents are desired to be as low as possible. Through ultra-low sulfur (less than 30 ppm) and Ca treatment to control the morphology of sulfide inclusions, the steel plate is guaranteed to have a good impact toughness. In the present invention, the content of S is controlled to 0.005% or less and the content of P is controlled to 0.015% or less.

Nitrogen (N): In microalloyed steel, appropriate content of nitrogen can inhibit the grain coarsening during the process of reheating slab and improve the strength and toughness of the steel by forming TiN particles with high melting point. However, if the content of N is too high, high concentration of free N atom after aging pins dislocations, thereby increasing the yield strength significantly and impairing the toughness. Therefore, the N content of the present invention is controlled to 0.008% or less.

Calcium (Ca): Through Ca-treatment, the morphology of elongated sulfides can be controlled and the spherical calcium aluminate inclusions are formed, which effectively improves the anisotropy of steel plates and low-temperature toughness. However, if the content of Ca is too low, the above effects cannot be achieved; and if the content of Ca is too high, CaS inclusions with high melting point are easily formed, resulting in poor castability of the steel. Therefore, the Ca content of the present invention is controlled to 0.0010-0.0040%.

Aluminum (Al): Al is an element added for deoxidation to the steel. Adding an appropriate amount of Al is conducive to refining the grains and improving the toughness of the steel.

In summary, in the composition design of the present invention, mainly by adding 0.05-0.16% of low-medium C, 1.25-2.5% of medium-high Mn, 0.51-1.30% of medium-high Cr, and microalloyed V, and by taking measures such as grain refinement, precipitation strengthening and phase transition, the strength and toughness are improved; and low carbon equivalent is beneficial for improving the welding performance; increasing Si content and Cr content and further increasing microalloying element V on the basis of Nb microalloying can meet the requirement for high strength of the pipe after heat treatment; using calcium treatment spheroidizes the inclusions, which avoids the formation of elongated inclusions that affect the usage, thereby improving the low-temperature toughness and fatigue resistance of the steel, and increasing the service life; through precipitation strengthening and grain refinement of microalloying element V, and solid solution strengthening and phase transition strengthening of other alloying elements, the strength is improved; and adding a relatively low content of Nb can avoid slab cracks during continuous casting under condition of high alloy, thereby improving the quality and manufacturability of the steel; using a relatively high content of Ni can improve the toughness of the steel and avoid hot cracking problem caused by a relatively high Cu.

A manufacturing method of the steel for coiled tubing with low yield ratio and ultra-high strength according to the present invention, comprising the following steps:

1) smelting and casting:

conducting electric furnace or converter smelting, external refining and continuous casting according to the above chemical composition, wherein LF desulfurization and RH vacuum degassing are conducted during the external refining, the RH vacuum degassing time is 5 min or more; and during the continuous casting process, degree of superheat is controlled to 15-30° C. and sedation time is controlled to 8-17 min;

2) hot rolling, wherein heating temperature is 1200-1260° C., final rolling temperature is 840-920° C. and coiling temperature is 450-550° C.;

3) pickling and coating oil, wherein coil loading temperature is 70° C. or less, pickling temperature is 65-80° C. and pickling time is 45-100 seconds.

Further, the steel for coiled tubing with low yield ratio and ultra-high strength has a microstructure consisting of MA constituents+bainite+ferrite multiphase microstructure.

The steel for coiled tubing with low yield ratio and ultra-high strength has a yield strength ($R_{p0.2}$) of 620 MPa or more, a tensile strength ($R_m$) of 750 MPa or more, an elongation ($A_{50}$) of 11% or more and a yield ratio ($R_{p0.2}/R_m$) of 0.83 or less.

In the step 1) of the present invention, the external refining comprises the LF desulfurization and the RH vacuum degassing (degassing time≥5 min). The S content in the steel can be reduced by LF smelting, which is conducive to reducing sulfide inclusions; and the RH vacuum degassing can lower the contents of O, N and H in the steel, reduce oxide inclusions during subsequent processing and reduce the effects of hydrogen cracking and nitrogen aging on the performance.

In the step 1) of the present invention, controlling the degree of superheat in the range of 15 to 30° C. and the sedation time in the range of 8 to17 min during the continuous casting process is conducive to the full floating of inclusions of the steel and to improving the purity of the steel while ensuring the segregation of the steel within level 2 of Mannesmann standard.

In the step 2) of the present invention, the heating temperature of the slab is controlled to 1200-1260° C. during the hot rolling process to ensure that the alloying elements are sufficiently solid-dissolved and to achieve the effects of grain refinement, phase transition control and precipitation strengthening during the subsequent process of deformation and phase transition.

In the present invention, controlling the final rolling temperature in the range of 840 to 920° C. and adopting a relatively low final rolling temperature are conducive to increasing the nucleation points, and the formation characteristics of ferrite of Cr promote phase transition of ferrite, refine the grains and avoid the formation of banded structure.

In the present invention, the coiling temperature is controlled in the range of 450 to 550° C., and in combination with the characteristics of Mo in reducing phase transition temperature and stabilizing austenite, coiling and holding the temperature under the above-mentioned temperature range are conducive to stabilizing the bainite phase transition process, promote C to be fully diffused into the retained austenite to further stabilize the retained austenite, and finally lead to formation of a microstructure with bainite as the matrix in which MA constituents are dispersedly distributed.

In the step 3) of the present invention, the coil loading temperature is controlled to 70° C. or lower. If the coil loading temperature is too high, the equipment will be damaged and the acid solution will easily volatilize. The pickling temperature is controlled to 65-80° C. If the pickling temperature is too low, the chemical reaction rate will be slow, which will cause the pickling to be unclean; and if the pickling temperature is too high, the acid solution will volatilize and the pickling effect will be affected. The pickling time is controlled to 45-100 seconds. If the pickling time is too short, the pickling will be unclean; and if the pickling time is too long, it will cause over-pickling and the surface of the steel will appear yellow. The present invention adopts the above-mentioned pickling process, which can effectively remove the iron oxide scale on the surface of the steel coil and improve the fatigue resistance of the steel.

In the present invention, through combination of composition design of medium carbon, Nb/V microalloying and Cu/Ni/Cr/Mo alloying, appropriate controlling of the rolling and low-temperature coiling processes and treatment of pickling and oiling, the steel for coiled tubing with low yield ratio, high strength and good corrosion resistance can be manufactured. The steel has a yield strength ($R_{p0.2}$) of 620 MPa or more, a tensile strength ($R_m$) of 750 MPa or more, an elongation ($A_{50}$) of 11% or more and a yield ratio ($R_{p0.2}/R_m$) of 0.83 or less. Moreover, the steel has a good surface quality, a thickness uniformity and a manufacturability that is more easily achieved, and can be used to manufacture coiled tubing with super strength which is suitable for deep wells and exploitation of unconventional oil and gas.

The beneficial effects of the present invention are as follows:

(1) In the present invention, through combination of adopting composition system of medium-low C, medium-high Mn and alloying, and appropriate techniques, high strength and high plasticity, good processability, and heat treatment adaptability of steel are achieved. A relatively high content of Cu and a relatively high content of Ni are added to obtain high strength and high corrosion resistance. The microalloying element V is added to achieve effects of grain refinement and precipitation strengthening, and an appropriate amount of Nb is added to further strengthen effects of grain refinement and precipitation strengthening, while avoiding continuous casting cracks. Cr element is added to promote the formation of ferrite and help to improve the corrosion resistance of steel. An appropriate amount of Mo element is added to promote bainite transformation, help to stabilize the retained austenite and improve or suppress the subsequent heat treatment brittleness. Low sulfur design is adopted and micro-Ca treatment is performed, so as to ensure that the steel has no elongated inclusions, and to improve the impact toughness and fatigue resistance.

(2) In regard to the techniques of the present invention, by adopting techniques of relatively low temperature final rolling and low temperature coiling, and employing the phase transition control effect of Cr and Mo alloying elements, an MA constituents+bainite+ferrite multiphase structure is obtained, and a low yield ratio and an ultra-high strength are achieved. The steel has superior performances such as processability and heat treatment adaptability.

(3) The steel according to the present invention has a yield strength ($R_{p0.2}$) of 620 MPa or more, a tensile strength ($R_m$) of 750 MPa or more, an elongation ($A_{50}$) of 11% or more and a yield ratio ($R_{p0.2}/R_m$) of 0.83 or less. Moreover, the steel has a good surface quality, a thickness uniformity and excellent integrated mechanical properties, which is suitable for manufacturing coiled tubing with super strength of 110 ksi or higher.

(4) In the present invention, the steel has a simple composition, the manufacturing process window is wide, and it is easy to implement on site.

BRIEF DESCRIPTION OF THE DRAWINGS

FIG. 1 is a typical microstructure of Example 4 of the present invention.

DETAILED DESCRIPTION

The present invention is further described below with reference to the Examples and the FIGURE.

Table 1 shows the composition of the steel of the Examples of the present invention, Table 2 shows the main process parameters of the steel of the Examples of the present invention, and Table 3 shows the properties of the steel of the Examples of the present invention.

The process route of the Examples of the present invention is: smelting→external refining→continuous casting→reheating slabs→controlling the rolling→cooling→coiling→coil loading→pickling→coating oil.

It can be seen from FIG. 1 that the steel structure manufactured by the present invention is an MA constituents+bainite+ferrite multiphase structure.

As can be seen from Table 3, the steel manufactured by the present invention has a yield strength ($R_{p0.2}$) of 620 MPa or more, a tensile strength ($R_m$) of 750 MPa or more, an elongation ($A_{50}$) of 11% or more and a yield ratio ($R_{p0.2}/R_m$) of 0.83 or less. Moreover, the steel has a good surface quality, a thickness uniformity and a manufacturability that is more easily achieved, and can be used to manufacture coiled tubing with ultra-high strength which is suitable for deep wells and exploitation of unconventional oil and gas.

TABLE 1

| | unit: wt % | | | | | | | | | | | | | | |
|---|---|---|---|---|---|---|---|---|---|---|---|---|---|---|---|
| | C | Mn | Si | S | P | Nb | Ti | Cu | Ni | Mo | Cr | Ca | Alt | V | N |
| Example 1 | 0.051 | 2.45 | 0.51 | 0.0021 | 0.011 | 0.017 | 0.022 | 0.60 | 0.31 | 0.32 | 0.51 | 0.0023 | 0.035 | 0.015 | 0.007 |
| Example 2 | 0.070 | 1.80 | 0.63 | 0.0018 | 0.009 | 0.014 | 0.028 | 0.55 | 0.48 | 0.11 | 0.58 | 0.0015 | 0.020 | 0.078 | 0.004 |
| Example 3 | 0.160 | 1.25 | 0.75 | 0.0015 | 0.012 | 0.006 | 0.020 | 0.35 | 0.32 | 0.22 | 1.29 | 0.0019 | 0.040 | 0.020 | 0.004 |
| Example 4 | 0.110 | 1.50 | 0.32 | 0.0011 | 0.011 | 0.018 | 0.010 | 0.32 | 0.32 | 0.12 | 0.63 | 0.0013 | 0.030 | 0.040 | 0.004 |
| Example 5 | 0.090 | 1.90 | 0.16 | 0.0012 | 0.008 | 0.016 | 0.015 | 0.50 | 0.42 | 0.55 | 0.55 | 0.0018 | 0.026 | 0.060 | 0.004 |
| Example 6 | 0.140 | 1.40 | 0.25 | 0.0008 | 0.013 | 0.019 | 0.013 | 0.31 | 0.31 | 0.13 | 0.75 | 0.0023 | 0.030 | 0.060 | 0.004 |
| Example 7 | 0.085 | 2.20 | 0.11 | 0.0020 | 0.012 | 0.009 | 0.015 | 0.45 | 0.56 | 0.10 | 0.52 | 0.0023 | 0.038 | 0.030 | 0.004 |

TABLE 2

| | mode of smelting | RH degassing time (min) | degree of superheat (° C.) | sedation time (min) | heating temperature (° C.) | final rolling temperature (° C.) | coiling temperature (° C.) | coil loading temperature (° C.) | pickling temperature (° C.) | pickling time (s) |
|---|---|---|---|---|---|---|---|---|---|---|
| Example 1 | Converter | 5 | 28 | 11 | 1220 | 843 | 480 | 70 | 65 | 80 |
| Example 2 | Converter | 8 | 25 | 17 | 1250 | 873 | 505 | 30 | 70 | 70 |
| Example 3 | Converter | 7 | 16 | 9 | 1215 | 915 | 535 | 60 | 80 | 50 |
| Example 4 | Converter | 8 | 25 | 17 | 1240 | 870 | 520 | 30 | 75 | 70 |
| Example 5 | Converter | 5 | 28 | 11 | 1230 | 850 | 510 | 70 | 75 | 80 |
| Example 6 | Converter | 6 | 20 | 10 | 1255 | 900 | 475 | 25 | 65 | 90 |
| Example 7 | Converter | 6 | 20 | 10 | 1245 | 885 | 460 | 20 | 70 | 90 |

TABLE 3

| | $R_{p0.2}$/MPa | $R_m$/MPa | $A_{50}$/% | $R_{p0.2}/R_m$ |
|---|---|---|---|---|
| Example 1 | 803 | 1163 | 13 | 0.69 |
| Example 2 | 698 | 884 | 16 | 0.79 |
| Example 3 | 898 | 1230 | 12 | 0.73 |
| Example 4 | 658 | 850 | 17 | 0.77 |
| Example 5 | 854 | 1182 | 14 | 0.72 |
| Example 6 | 723 | 1003 | 15 | 0.72 |
| Example 7 | 778 | 1089 | 14 | 0.71 |

The invention claimed is:

1. A steel for coiled tubing with low yield ratio and ultra-high strength, comprising the following chemical composition in percentage by mass: C: 0.05-0.16%, Si: 0.1-0.9%, Mn: 1.25-2.5%, P≤0.015%, S≤0.005%, Cr: 0.51-1.30%, Nb: 0.005-0.019%, V: 0.020-0.079%, Ti: 0.01-0.03%, Mo: 0.10-0.55%, Cu: 0.31-0.60%, Ni: 0.31-0.60%, Ca: 0.0010-0.0040%, Al: 0.01-0.05%, N≤0.008%, and the rest being Fe and inevitable impurity elements, and wherein the steel for coiled tubing with low yield ratio and ultra-high strength has a yield strength ($R_{p0.2}$) of 620 MPa or more, a tensile strength ($R_m$) of 750 MPa or more, an elongation ($A_{50}$) of 11% or more and a yield ratio ($R_{p0.2}/R_m$) of 0.83 or less.

2. The steel for coiled tubing with low yield ratio and ultra-high strength as claimed in claim 1, wherein the steel for coiled tubing with low yield ratio and ultra-high strength has a microstructure consisting of MA constituents+bainite+ferrite multiphase structure.

3. A manufacturing method of the steel for coiled tubing with low yield ratio and ultra-high strength as claimed in claim 1, comprising the following steps:

1) conducting electric furnace or converter smelting, external refining and continuous casting of the chemical components recited in claim 1, wherein the external refining comprises LF desulfurization and RH vacuum degassing, the RH vacuum degassing time is 5 min or more; and during the continuous casting process, degree of superheat is controlled to 15-30° C. and sedation time is controlled to 8-17 min;
2) hot rolling, wherein heating temperature is 1200-1260° C., final rolling temperature is 840-920° C. and coiling temperature is 450-550° C.; and
3) pickling and oiling, wherein coil loading temperature is 70° C. or less, pickling temperature is 65-80° C. and pickling time is 45-100 seconds; thereby producing the steel with low yield ratio and ultra-high strength of claim 1.

4. The manufacturing method of the steel for coiled tubing with low yield ratio and ultra-high strength as claimed in claim 3, wherein the steel for coiled tubing with low yield ratio and ultra-high strength has a microstructure consisting of MA constituents+bainite+ferrite multiphase structure.

* * * * *